US012036592B2

(12) United States Patent
Gorgels et al.

(10) Patent No.: US 12,036,592 B2
(45) Date of Patent: Jul. 16, 2024

(54) FLATNESS-MEASURING APPARATUS FOR MEASURING THE FLATNESS OF A METAL STRIP

(71) Applicant: SMS group GmbH, Düsseldorf (DE)

(72) Inventors: Frank Gorgels, Aachen (DE); Andreas Kastner, Kirchhundem (DE)

(73) Assignee: SMS GROUP GMBH, Düsseldorf (DE)

( * ) Notice: Subject to any disclaimer, the term of this patent is extended or adjusted under 35 U.S.C. 154(b) by 337 days.

(21) Appl. No.: 17/621,473

(22) PCT Filed: May 13, 2020

(86) PCT No.: PCT/EP2020/063312
§ 371 (c)(1),
(2) Date: Dec. 21, 2021

(87) PCT Pub. No.: WO2020/259912
PCT Pub. Date: Dec. 30, 2020

(65) Prior Publication Data

US 2022/0347730 A1 Nov. 3, 2022

(30) Foreign Application Priority Data

Jun. 25, 2019 (DE) ..... 10 2019 209 124.5
Nov. 14, 2019 (DE) ..... 10 2019 217 569.4

(51) Int. Cl.
*B21B 37/28* (2006.01)
*B21B 1/24* (2006.01)
*B21B 45/02* (2006.01)

(52) U.S. Cl.
CPC ..... *B21B 37/28* (2013.01); *B21B 1/24* (2013.01); *B21B 45/0218* (2013.01)

(58) Field of Classification Search
CPC ..... B21B 37/28; B21B 37/32; B21B 37/44; B21B 38/02; B21B 2263/04; B21B 1/24;
(Continued)

(56) References Cited

U.S. PATENT DOCUMENTS 4,188,809 A 2/1980 Ishimoto et al.
6,354,013 B1 * 3/2002 Mucke ..... B21B 38/02 33/501.02

(Continued)

FOREIGN PATENT DOCUMENTS

CN 1308998 A 8/2001
CN 1349863 A 5/2002

(Continued)

OTHER PUBLICATIONS

DE 19609135A1, Berghs et al. Sep. 1997.*

(Continued)

*Primary Examiner* — Edward T Tolan
(74) *Attorney, Agent, or Firm* — Maier & Maier, PLLC

(57) ABSTRACT

A flatness measuring apparatus for measuring the flatness of a metallic strip, including a measuring roller which has a roller axis and which makes contact with the strip for the measuring the flatness. The measuring roller is connected to a cooling system, using which the measuring roller can be cooled. To ensure that a high degree of measuring accuracy can be maintained even at high temperatures, the cooling system has a nozzle bar that extends parallel to the roller axis. At least one spray nozzle is arranged on the nozzle bar, using which cooling medium can be sprayed on the surface of the measuring roller in a spraying direction. The spraying direction meets a surface section of the measuring roller, and the angle between the spraying direction and the tangent on the measuring roller at the location of the surface section is less than 30°.

9 Claims, 2 Drawing Sheets

(58) Field of Classification Search
CPC ..... B21B 2027/103; B21B 45/0218; B21B 45/0233; G01L 5/045
USPC ..... 72/9.1, 11.7; 700/154
See application file for complete search history.

(56) References Cited

U.S. PATENT DOCUMENTS

| | | | | |
|---|---|---|---|---|
| 6,729,757 | B2 * | 5/2004 | Faure | G01B 5/285 73/159 |
| 7,856,894 | B2 * | 12/2010 | Kipping | G01L 5/045 73/862.451 |
| 8,051,692 | B2 * | 11/2011 | Hayashi | B21B 38/02 72/31.09 |
| 2019/0381552 | A1 * | 12/2019 | Xavier | B21B 45/0239 |

FOREIGN PATENT DOCUMENTS

| | | | |
|---|---|---|---|
| CN | 107427876 | A | 12/2017 |
| EP | 0542640 | A1 | 5/1993 |
| EP | 1199543 | B1 | 9/2009 |
| JP | 2015080794 | A | 4/2015 |
| WO | 2006134696 | A1 | 12/2006 |

OTHER PUBLICATIONS

DE 202005012465 U1, Achenbach Buschhutten Oct. 2005.*
KR 100711399 B1, Lee et al. Apr. 2007.*
CN 108144967A, Sun et al. Jun. 2018.*
KR 20140083644A, Jang et al. Jul. 2014.*
WO 2012/171514A1, Kipping et al. Dec. 2012.*
Office Action issued on Mar. 7, 2023, in corresponding Chinese Patent Application No. 202080047374.2, 15 pages.
International Search Report (with English translation) and Written Opinion (with Machine translation) issued on Aug. 7, 2020 in corresponding International Application No. PCT/EP2020/063312; 16 pages.
International Preliminary Report on Patentability issued on Oct. 5, 2021 in corresponding International Application No. PCT/EP2020/063312; 63 pages.

* cited by examiner

FLATNESS-MEASURING APPARATUS FOR MEASURING THE FLATNESS OF A METAL STRIP

FIELD

The invention relates to a flatness measuring apparatus for measuring the flatness of a metal strip, comprising a measuring roller which has a roller axis and which is designed to make contact with the strip for the purpose of measuring the flatness, wherein the measuring roller is connected to a cooling system, using which the measuring roller can be cooled.

BACKGROUND

A device of the generic type is known from EP 1 199 543 B1. A measuring roller is immersed here with a circumferential section facing away from the strip to be measured into a container filled with cooling liquid, whereby the roller is cooled. According to a further solution, the measuring roller is sprayed with cooling medium from the radial direction by cooling nozzles. The general cooling of rollers is disclosed in EP 0 542 640 A1 and JP 2015-80794 A.

U.S. Pat. No. 4,188,809 A discloses a measuring roller in a cold rolling mill, under which a number of sensors are arranged, using which the size of a gap that forms between the sensors in the measuring roller is measured. WO 2006/134696 A1 and EP 1 199 543 B1 disclose similar solutions.

SUMMARY

The present invention relates to measuring the flatness in a forming process of metallic strip, in particular and preferably in a hot rolling mill. The cooling of the measuring roller during measuring operation is particularly important, especially when it is used in a hot rolling mill.

When rolling steel, optical systems are often used that can measure the flatness of the rolled strip as long as the head of the strip has not yet been picked up by the reel. As soon as the reel has picked up the strip and put it under tensile stress, the deviations in flatness are no longer visible and can therefore no longer be detected optically or can only be detected optically in the case of significant deviations.

Flatness measuring systems are known from the cold rolling process that are able to measure flatness deviations which are not visible due to superimposed tensile stress. These systems measure the tensile stress differences across the width of the strip caused by the flatness deviation. This predominantly involves deflection rollers which are equipped with a sensor system that is capable of measuring the radial force exerted on the deflection roller by the tensile stress. By measuring the radial force in regions limited locally over the width, these systems are capable of measuring the local deviation of the tensile stress from the mean tensile stress. These deviations are directly proportional to the flatness deviation.

The use of this measuring technology, which is known from cold rolling technology, in hot rolling places very high demands on the robustness of the system with regard to temperature and wear, while at the same time requiring high sensitivity due to the lower tensile stresses. This requires the use of a high-efficiency cooling system that protects the sensors but has no influence on the measurement and does not interfere with the temperature control of the hot rolling process.

In previously known solutions (see EP 1 199 543 B1 cited), the measuring roller is cooled by a cooling box arranged below the measuring roller. Since this means that the roller has to be plunged into the strip from below, two additional rollers are required above the strip. These additional rollers have to be swiveled away to thread the strip in and out, which requires an additional mechanism. Arrangements having only one additional roller result in unfavorable geometrical relationships between the spacing of the rollers and the strip width, which results in measurement errors upon the slightest alignment errors. An arrangement of a single roller with sufficient spacing results in a wrap angle that is too small and thus a considerable impairment of the measurement accuracy. The cooling by a cooling medium located in a cooling box is not effective, since only low relative speeds can be achieved on the roller surface due to the stationary medium.

When using the spray cooling systems known from the roller cooling systems, the problem arises that the measurement is disturbed due to the forces ("impact") exerted by the cooling nozzle jet on the roller surface. Furthermore, if the measuring roller were arranged above the strip, the cooling medium would influence the cooling process of the strip and thus change the quality of the product. When winding the strip, it is often necessary to completely remove the cooling medium from the surface of the strip for reasons of surface quality. Therefore, the use of the cooling medium at the measuring roller has to be reduced to such an extent that highly efficient cooling is no longer possible. The use of wipers on a closed cooling box, which keeps the cooling medium in the closed space, also results in an influence on the measurement signal due to the exerted pressure that these wipers exert on the measuring roller. Due to the impact of the nozzle jets, the locally very high heat transfer coefficient results in high temperature gradients both locally and over time. These gradients also result in interferences with the measurement signal due to the deformations of the roller caused by the temperature expansion.

The invention is based on the object of developing a flatness measuring apparatus of the generic type in such a way that it is possible to use it even at high temperatures and in particular in hot rolling mills, while at the same time it is to be ensured that a high degree of measuring accuracy can be maintained.

The cooling of the flatness measuring roller is to take place so that the cooling of the roller is sufficiently effective even at temperatures of the strip to be measured up to 1000° C. that a practical service life of the measuring roller can be achieved. Furthermore, the sensor system used, which is sensitive enough to measure the flatness defects occurring during hot rolling with sufficient accuracy, is to be protected from excessive heat input. The cooling cannot cause any thermal or mechanical interference with the measurement. The cooling medium is to be used in such a way that the quality of the product produced is not influenced by uncontrolled exposure to the cooling medium.

The achievement of this object by the invention is characterized in that the measuring roller is designed as a deflection roller which is equipped with a sensor system that is capable of measuring the radial force exerted by the tensile stress on the deflection roller, the flatness measuring apparatus is part of a hot rolling mill, and the cooling system has a nozzle bar that extends parallel to the roller axis, wherein at least one, preferably a number of, spray nozzles is/are arranged on the nozzle bar, using which cooling medium can be sprayed on the surface of the measuring roller in a spraying direction, wherein the spraying direction meets a surface section of the measuring roller, and wherein the angle between the spraying direction and the tangent on the measuring roller at the location of the surface section is less than 30°.

The angle is preferably between 0° and 20°, particularly preferably between 0° and 10°.

The spray nozzles are preferably flat jet nozzles. It is preferably provided here that the flat jet nozzles discharge a cooling medium jet which is at least 4 times as wide as it is thick, particularly preferably at least 8 times as wide as it is thick. The width of the jet of the flat jet nozzles preferably extends in the direction of the roller axis.

Although a number of spray nozzles are preferably provided, it is also possible that only a single wide slot nozzle is arranged on the nozzle bar.

The spray nozzles are preferably aligned in such a way that the cooling medium is discharged against the running direction of the measuring roller. The direction of movement of the sprayed cooling medium is opposite to the direction of movement of the surface of the roller at which the coolant touches the roller.

The cooling system can have at least one further nozzle bar, which extends parallel to the roller axis and is arranged offset to the first, above-mentioned nozzle bar in the circumferential direction of the measuring roller, wherein a number of spray nozzles are arranged on the further nozzle bar, using which cooling medium can be sprayed on the surface of the measuring roller in a spraying direction, wherein the spraying direction meets a surface section of the measuring roller and wherein the angle between the spraying direction and the tangent on the measuring roller at the location of the surface section is less than 30°, preferably between 0° and 20°, and particularly preferably between 0° and 10°.

One refinement of the invention provides that the cooling system comprises a housing which encloses the nozzle bar or bars and a circumferential section, preferably at least 180° of the circumference, of the measuring roller. Two gaps can be formed between the housing and the measuring roller, which make it difficult for the cooling medium to pass through. With regard to the measuring roller, the housing is preferably dimensioned in such a way that the gaps are in the range between 0.01 mm and 2.0 mm.

Furthermore, it can be provided that means for delivering a (barrier) gas are arranged in the region of the gaps, using which a gas flow can be guided into the interior of the housing. In this way, the escape of cooling medium from the interior of the housing can be minimized or even prevented entirely. The means for delivering a gas can comprise slot nozzles which extend in the longitudinal direction of the gaps, wherein the slot nozzles are preferably integrated into the housing in the region of the gaps.

The flatness measuring apparatus is preferably part of a hot rolling mill.

The proposed concept is therefore based on spray cooling of the measuring roller, which is arranged on (at least) one nozzle bar aligned parallel to the roller axis. Flat jet nozzles are preferably used as spray nozzles. The flat jet is aligned so that the long axis of the oval circumscribing the jet is preferably parallel to the roller axis; however, the angle between the long jet axis and the roller axis can also be up to 10°. The spray nozzles are furthermore aligned so that the jet strikes the roller surface at a flat angle, preferably between 0° and 10°; 0° means in this case that the jet strikes the measuring roller tangentially.

The spacing of the nozzles along the roller barrel is preferably selected so that the most uniform possible application to the roller surface takes place along the points of impact of the cooling medium according to the geometry of the jets.

The mentioned further nozzle bar is placed at a further position above the circumference of the roller in relation to the first-mentioned nozzle bar. The further nozzle bar can be varied with regard to its geometry and/or its arrangement and/or its alignment of the nozzles. Furthermore, with regard to the (at least one) further nozzle bar, the discharge of the cooling medium can vary with regard to the pressure and/or the flow rate of the cooling medium in relation to the first-mentioned nozzle bar.

The mentioned refinement provides that the region of the measuring roller, which is subjected to the spray cooling, is sealed off from the environment by the mentioned closed housing. The gap between the rotating roller and the housing is preferably minimized to such an extent that in running operation The region of the housing directly adjoining the gap between the roller surface and the housing, where the rotating roller enters the housing, is preferably designed in such a way that the cooling medium collects directly at the gap and cooling medium is thus uniformly applied to the roller surface over the entire barrel width. The roller surface is preferably provided with a rough surface and is continuously kept in motion for cooling. The rotational velocity of the roller is preferably not to fall below a minimum predetermined value.

As mentioned, the gap between the housing and the measuring roller can be subjected to a gaseous medium. The flow direction of the medium is preferably directed into the interior of the housing. The nozzle for applying the medium is preferably designed as a slot nozzle. The slot nozzle is preferably integrated in the area of the gap.

The gap between the roller surface and the housing, at which the roller surface exits from the housing, can also be designed in such a way that a controlled small amount of the cooling medium remains on the surface of the measuring roller.

The proposed solution ensures effective cooling of the measuring roller without interfering with the measuring signal due to the jet geometry of the cooling nozzles and the flat angle of incidence.

The arrangement of the nozzles against the running direction of the roller and the design of the housing advantageously prevent the quality of the measured strips from being influenced, since the cooling medium can be effectively kept in the housing, collected, and returned to the circuit in a controlled manner.

Due to the controlled wetting of the rotating measuring roller, the cooling medium is brought into the contact surface between the hot strip and the measuring roller in a controlled manner. This can dampen the heat transfer and thus minimize the heat introduction into the roller. At the same time, wear is minimized by utilizing the aquaplaning effect.

BRIEF DESCRIPTION OF THE FIGURES

An exemplary embodiment of the invention is shown in the drawing. In the figures.

DETAILED DESCRIPTION

Figure 1:
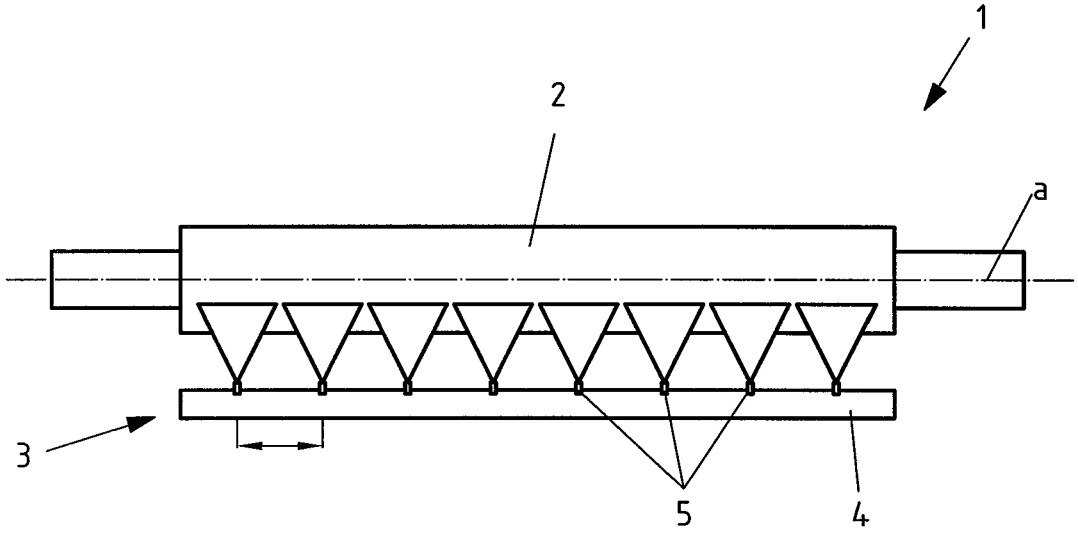
FIG. 1 schematically shows a flatness measuring apparatus having a measuring roller and a cooling system, wherein the conveying direction of the strip to be measured (not shown) is perpendicular to the point of the drawing, FIG. 2 schematically shows a spray nozzle which discharges the cooling medium, FIG. 3 schematically shows details of the cooling system using which the measuring roller is cooled, wherein the roller axis is perpendicular to the plane of the drawing, and FIG. 4 schematically shows the flatness measuring apparatus having a housing.

In FIG. 1, a flatness measuring apparatus 1 can be seen, which comprises a measuring roller 2, which is used to contact a metallic strip (not shown) The degree of flatness of the strip can thus be determined in a manner known per se. In order that the flatness measuring apparatus 1 can also be used in a hot rolling mill, the measuring roller 2 has to be cooled, for which a cooling system 3 is provided. The cooling system 3 comprises a nozzle bar 4, the longitudinal axis of which is parallel to the roller axis a, as can be seen from FIG. 1. Spray nozzles 5 are arranged at regular intervals on the nozzle bar 4; the spacing is marked by the double arrow in FIG. 1.

Figure 2:
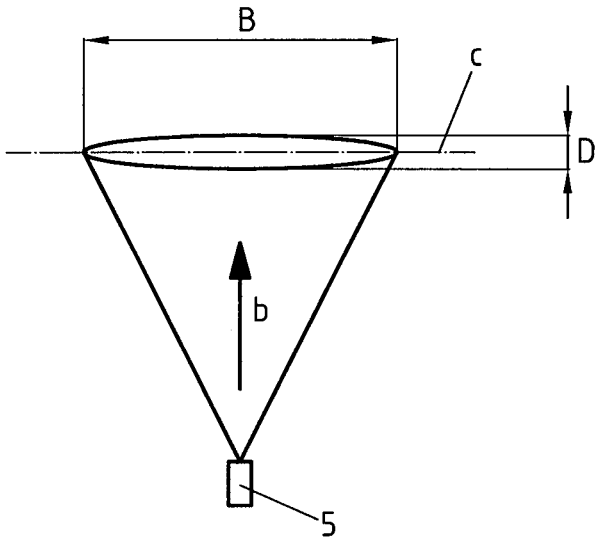

Each spray nozzle 5 discharges a jet of cooling medium that is relatively flat. This is illustrated in FIG. 2 The cooling medium is discharged from the spray nozzle 5 in the spray direction b, wherein the spray nozzle 5 is designed as a wide slot nozzle or flat jet nozzle. Accordingly, the cooling medium reaches the surface of the measuring roller 2 having an essentially oval contact area, which has a width B and a thickness D. The contact area that the cooling medium has on the surface of the measuring roller 2 can thus be assigned a longitudinal axis c which is parallel to the roller axis a. The width B is at least four times as large as the (maximum) thickness D, preferably even at least eight times as large.

Figure 3:
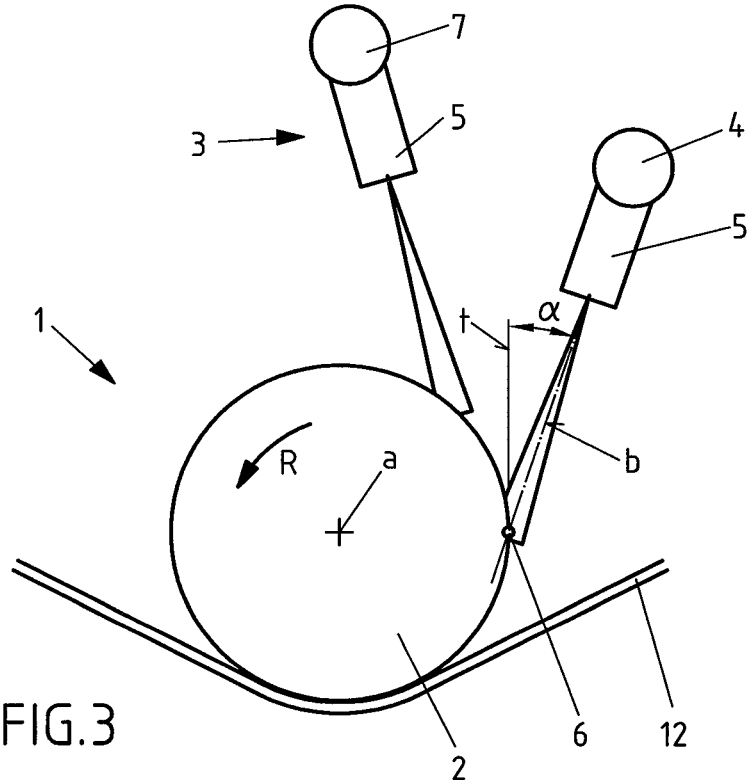

Details of the cooling system 3 used can be seen in FIG. 3 The measuring roller 2 contacts the strip 12 and rotates in the rotational direction R, wherein its roller axis a is perpendicular to the plane of the drawing in FIG. 3. The cooling system 3 first comprises an (upper) nozzle bar 4 on which the spray nozzles 5 are arranged. Furthermore, it comprises a (lower) nozzle bar 7, on which spray nozzles 5 are likewise arranged. This nozzle bar 7 is optional and is arranged offset in the circumferential direction.

The alignment of the spray nozzles 5 for cooling the surface of the measuring roller 2 is essential. For this purpose, it can be seen in FIG. 3 that the spray nozzles 5 discharge their cooling medium with their spraying direction b at a point or a surface section 6 of the measuring roller 2. If a tangent t is placed on the measuring roller 2 at the point or surface section 6, an angle $\alpha$ results between the spraying direction b and the tangent t. This angle $\alpha$ is relatively small and is at most 20°. The preferred range for the angle $\alpha$ is between 0° and 10°.

The two nozzle bars 4 and 7 are arranged offset in the circumferential direction above the measuring roller 2. For the angular relationships of the impact of the cooling medium on the surface of the measuring roller in the region of the surface section 6, however, the same geometric relationships apply.

Figure 4:
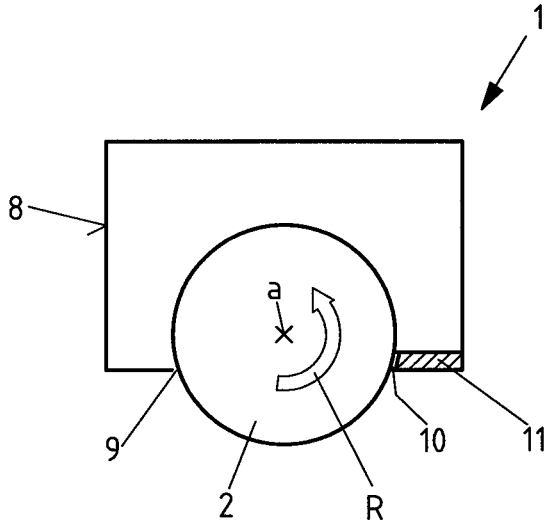

In FIG. 4 it can be seen that the flatness measuring apparatus 1 can also have a housing 8 which accommodates the nozzle bars 4 and 7 (not shown here) and encloses the measuring roller over a circumferential section of at least 180°. Small gaps 9 and 10 ensure that only a small amount of cooling medium escapes from the interior of the housing. Liquid leakage can be completely prevented by applying sealing air (as described above).

In the interior of the housing 8, cooling medium 11 collects, which cools the measuring roller 2 over the entire width as it rotates. Meanwhile, it is ensured by the explained geometry in the alignment of the spray nozzles 5 that the measuring function of the measuring roller 2 is not impaired. This is not the case with previously known solutions.

LIST OF REFERENCE SIGNS

1 flatness measuring apparatus
2 measuring roller
3 cooling system
4 nozzle bar
5 spray nozzle
6 surface section of the measuring roller
7 further nozzle bar
8 housing
9 gap
10 gap
11 accumulated cooling medium
12 volume
a roller axis
b spraying direction
c longitudinal axis of the discharged cooling medium
t tangent to the measuring roller
B width of the coolant jet
D thickness of the coolant jet
R rotational direction
$\alpha$ angle

The invention claimed is:

1. A flatness measuring apparatus for measuring the flatness of a metallic strip, comprising a measuring roller which has a roller axis and which is designed to make contact with the strip for the purpose of measuring the flatness, wherein the measuring roller is connected to a cooling system configured to cool the measuring roller, the measuring roller is designed as a deflection roller which is equipped with a sensor system that is configured to measure a radial force exerted by a tensile stress on the deflection roller, the flatness measuring apparatus is part of a hot rolling mill, and the cooling system comprises:

a first nozzle bar that extends parallel to the roller axis, wherein a first plurality of spray nozzles is arranged on the first nozzle bar and configured to spray a cooling medium on a surface of the measuring roller in a spraying direction, the spraying direction meets a surface section of the measuring roller, and an angle between the spraying direction and a tangent on the measuring roller at a location of the surface section is less than 30°, a second nozzle bar, which extends parallel to the roller axis and is arranged offset to the first nozzle bar in the circumferential direction of the measuring roller, wherein a second plurality of spray nozzles is arranged on the second nozzle bar and configured to spray the cooling medium on the surface of the measuring roller in the spraying direction, and the angle between the spraying direction and the tangent on the measuring roller at the location of the surface section is less than 30°.

2. The flatness measuring apparatus according to claim 1, wherein the angle is between 0° and 10°.

3. The flatness measuring apparatus according to claim 1, wherein the spray nozzles are flat jet nozzles which emit a cooling medium jet that is at least 4 times as wide as thick.

4. The flatness measuring apparatus according to claim 3, wherein the width of the jet of the flat jet nozzles extends in the direction of the roller axis.

5. The flatness measuring apparatus according to claim 1, wherein the spray nozzles are aligned in such a way that the cooling medium is discharged against a running direction of the measuring roller.

6. The flatness measuring apparatus according to claim 1, wherein the cooling system comprises a housing which encloses the nozzle bar or bars and a circumferential section, at least 180° of the circumference, of the measuring roller.

7. The flatness measuring apparatus according to claim 6, wherein two gaps are formed between the housing and the measuring roller which make the passage of cooling medium difficult.

8. The flatness measuring apparatus according to claim 7, wherein means for delivering a gas are arranged in the region of the gaps, to which a gas flow can be guided in the interior of the housing.

9. The flatness measuring apparatus according to claim 8, wherein the means for delivering a gas comprise slot nozzles which extend in the longitudinal direction of the gaps, wherein the slot nozzles are integrated into the housing in the region of the gaps.

* * * * *